US008292753B1

(12) United States Patent
Galloway

(10) Patent No.: US 8,292,753 B1
(45) Date of Patent: Oct. 23, 2012

(54) DEVICE TO MEASURE THE MOTION OF A GOLF CLUB THROUGH MEASUREMENT OF THE SHAFT USING WAVE RADAR

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 396 days.

(21) Appl. No.: 12/790,001

(22) Filed: May 28, 2010

Related U.S. Application Data

(60) Provisional application No. 61/183,875, filed on Jun. 3, 2009.

(51) Int. Cl.
*A63B 69/36* (2006.01)

(52) U.S. Cl. ..... 473/221; 473/225

(58) Field of Classification Search ..... 473/150, 473/151, 219, 221–226, 275, 407, 409
See application file for complete search history.

(56) References Cited

U.S. PATENT DOCUMENTS 3,270,564 A * 9/1966 Evans ..... 73/865.4
3,788,647 A * 1/1974 Evans ..... 473/223
4,137,566 A * 1/1979 Haas et al. ..... 473/209
5,056,783 A * 10/1991 Matcovich et al. ..... 473/453
6,224,493 B1 5/2001 Lee et al.
6,402,634 B2 6/2002 Lee et al.
6,431,990 B1 8/2002 Manwaring
6,638,175 B2 10/2003 Lee et al.
6,821,209 B2 * 11/2004 Manwaring et al. ..... 473/198
7,163,468 B2 1/2007 Gibbs et al.
7,163,470 B2 1/2007 Galloway et al.
7,166,038 B2 1/2007 Williams et al.
7,214,143 B2 5/2007 Deshmukh
7,252,600 B2 8/2007 Murphy et al.
7,258,626 B2 8/2007 Gibbs et al.
7,258,631 B2 8/2007 Galloway et al.
7,273,419 B2 9/2007 Evans et al.
7,892,102 B1 * 2/2011 Galloway ..... 473/225
8,062,145 B1 * 11/2011 Galloway ..... 473/225
8,118,687 B1 * 2/2012 Galloway ..... 473/221
8,120,332 B2 * 2/2012 Balardeta et al. ..... 320/166
8,162,772 B1 * 4/2012 Galloway ..... 473/225
2006/0125691 A1 * 6/2006 Menache et al. ..... 342/450
2007/0105639 A1 * 5/2007 Hasegawa ..... 473/221
* cited by examiner

*Primary Examiner* — Nini Legesse
(74) *Attorney, Agent, or Firm* — Michael A. Catania; Sonia Lari; Rebecca Hanovice

(57) ABSTRACT

A club shaft that can be installed in a club head permanently or can be installed in clubs with interchangeable shaft features is disclosed herein. The invention is a measurement device that enables the capturing of the speed and motion of the swing. The invention uses two antennas, one transmitting and one receiving. The power of the radar wave is low. The wavelength will be on the order of a millimeter.

12 Claims, 1 Drawing Sheet

DEVICE TO MEASURE THE MOTION OF A GOLF CLUB THROUGH MEASUREMENT OF THE SHAFT USING WAVE RADAR

CROSS REFERENCES TO RELATED APPLICATIONS

The Present Application claims priority to U.S. Provisional Patent Application No. 61/183,875, filed on Jun. 3, 2009.

STATEMENT REGARDING FEDERALLY SPONSORED RESEARCH OR DEVELOPMENT

Not Applicable

BACKGROUND OF THE INVENTION

1. Field of the Invention

The present invention relates to a swing analysis devices for golf clubs. More specifically, the present invention relates to a golf club swing analysis device that uses millimeter wave radar.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to measure the motion of the club through measurement of the shaft.

BRIEF SUMMARY OF THE INVENTION

The present invention is novel in that the observation of the relative motion does not depend on near visible light and uses a coherent pattern to capture the position of the club relative the ground antenna transmitter/receiver. This fixed device also includes a display, computing capability and recording device. This information, when processed, enables the display of the swing and uses data on the club head and ball to calculate the flight of the ball.

This invention is a club shaft that can be installed in a club head permanently or can be installed in clubs with interchangeable shaft features. The invention is the measurement device that enables the capturing of the speed and motion of the swing. The invention uses two antennas, one transmitting and one receiving. The power of the radar wave is low. The wavelength will be on the order of a millimeter. The antennas' shapes are designed to improve the accuracy of measurement of location as a function of time. One antenna is designed to conform to the shaft or reside in the shaft. Material substitutions in the shaft can be utilized to improve the antenna function. In the first embodiment, the antenna in the shaft shall be attached to a power source, battery and a simple electronic circuit. The second antenna, the transmitting/receiver, will reside off the club and will receive the transmissions of the shaft antenna. The second embodiment will have a shaft antenna that does not rely on a battery, but reflects an electromagnetic field back to the transmitting/receiving antenna. In either case, the interactions of characteristic three dimensional amplitude variations in the antennas, their patterns, allow the measurement of relative positions over time.

The invention enables the accurate measurement and capture of the swing, produces a display of the impact and ball flight and thus improves the training and practice results for the golfer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
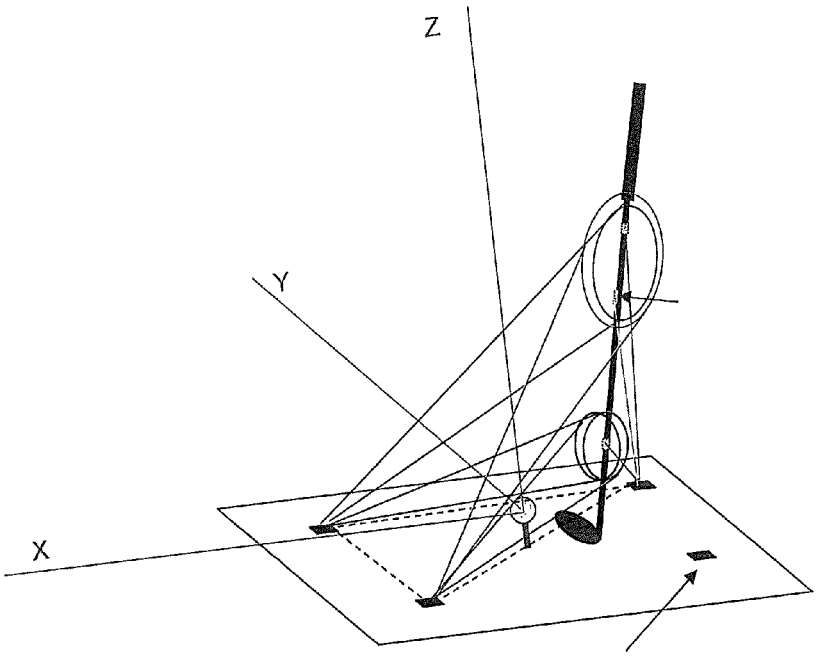
FIG. 1 is a perspective view of system for measuring the motion of a club through a sensor field.

As shown in FIG. 1, a golf club bearing radiofrequency ("RF") tags on a shaft is swung through a sensor field at a golf ball. In one embodiment, the RF tags on the shaft are active RF tags that are powered by a battery source and transmit a RF signal. In this embodiment, sensors located on a surface have RF antennas that receive the signals from the RF tags on the shaft as the golf club is swung through the field.

In another embodiment, the RF tags on the shaft are passive RF tags that receive RF signals from the sensors on the surface to power the RF tag for transmission of a signal from the RF tag on the shaft.

Figure 2:
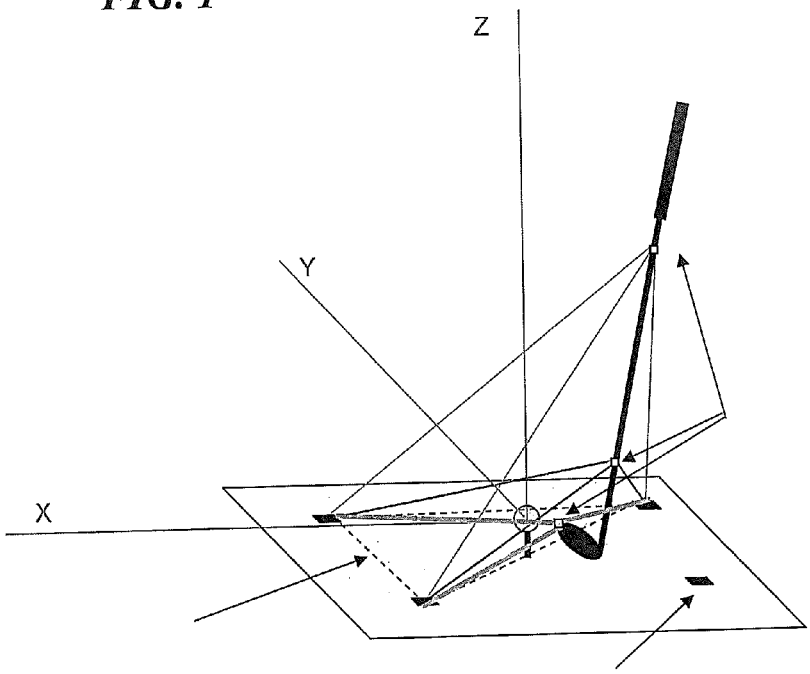
FIG. 2 is a perspective view of system for measuring the motion of a club through a sensor field.

As shown in FIG. 2, RF tags are positioned on the shaft and the club head as the golf club is swung through a field of sensors. In one embodiment, the RF tags on the shaft are active RF tags that are powered by a battery source and transmit a RF signal. In this embodiment, sensors located on a surface have RF antennas that receive the signals from the RF tags on the shaft as the golf club is swung through the field.

In another embodiment, the RF tags on the shaft are passive RF tags that receive RF signals from the sensors on the surface to power the RF tag for transmission of a signal from the RF tag on the shaft.

The following patents disclose various golf clubs that may be used with the device of the present invention. Gibbs, et al., U.S. Pat. No. 7,163,468 is hereby incorporated by reference in its entirety. Galloway, et al., U.S. Pat. No. 7,163,470 is hereby incorporated by reference in its entirety. Williams, et al., U.S. Pat. No. 7,166,038 is hereby incorporated by reference in its entirety. Desmukh U.S. Pat. No. 7,214,143 is hereby incorporated by reference in its entirety. Murphy, et al., U.S. Pat. No. 7,252,600 is hereby incorporated by reference in its entirety. Gibbs, et al., U.S. Pat. No. 7,258,626 is hereby incorporated by reference in its entirety. Galloway, et al., U.S. Pat. No. 7,258,631 is hereby incorporated by reference in its entirety. Evans, et al., U.S. Pat. No. 7,273,419 is hereby incorporated by reference in its entirety. Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A system for measuring the motion of a golf club swung by a golfer, the system comprising:

a golf club comprising a shaft and a golf club head, the shaft having a plurality of radiofrequency tags, the plurality of radiofrequency tags comprising at least an upper shaft radiofrequency tag and a lower shaft radiofrequency tag;

a plurality of radiofrequency sensors positioned in proximity to a golf ball to create a swing field for reception of radiofrequency signals from the plurality of radiofrequency tags as the golf club is swung through the swing field to strike the golf ball;

wherein the plurality of radiofrequency sensors captures a speed and motion of the golf club as the golf club is swung through the swung through the swing field.

2. The system according to claim 1 wherein each of the plurality of radiofrequency tags is a passive RF tag.

3. The system according to claim 1 wherein each of the plurality of radiofrequency tags is an active RF tag.

4. The system according to claim 1 wherein each of the plurality of radiofrequency tags transmits at 2.4 gigaHertz.

5. The system according to claim 1 wherein the plurality of radiofrequency sensors comprises four radiofrequency sensors positioned equidistant from the golf ball.

6. A system for measuring the motion of a golf club swung by a golfer, the system comprising:

a golf club comprising a shaft and a golf club head, the shaft having at least one radiofrequency tag thereon and the golf club head having at least one radiofrequency tag thereon;

a plurality of radiofrequency sensors positioned in proximity to a golf ball to create a swing field for reception of radiofrequency signals from the at least one RF tag as the golf club is swung through the swing field to strike the golf ball wherein the plurality of radiofrequency sensors captures a speed and motion of the golf club as the golf club is swung through the swung through the swing field.

7. The system according to claim 6 wherein each of the at least one radiofrequency tag on the shaft and the at least one radiofrequency tag on the golf club head is a passive radiofrequency tag.

8. The system according to claim 6 wherein each of the at least one radiofrequency tag on the shaft and the at least one radiofrequency tag on the golf club head is an active radiofrequency tag.

9. The system according to claim 6 wherein each of the at least one radiofrequency tag on the shaft and the at least one radiofrequency tag on the golf club head transmits at 2.4 gigaHertz.

10. The system according to claim 6 wherein the plurality of radiofrequency sensors comprises four radiofrequency sensors positioned equidistant from the golf ball.

11. A system according to claim 6 further comprising a second radiofrequency tag on the shaft.

12. A method for measuring the motion of a golf club swung by a golfer, the method comprising:

swinging a golf club through a swing field at a golf ball, the golf club comprising a shaft and a golf club head, the shaft having at least one radiofrequency tag thereon and the golf club head having at least one radiofrequency tag thereon, the swing field created by a plurality of radiofrequency sensors positioned equidistance from the golf ball;

receiving a plurality of radiofrequency signals at the plurality of radiofrequency sensors from the at least one radiofrequency tag on the shaft and the at least one radiofrequency tag on the golf club head; and detecting an orientation of the golf club head at impact with the golf ball, the speed of the swing and the flight of the golf ball after impact from the plurality of radiofrequency signals received at the plurality of radiofrequency sensors.

* * * * *